United States Patent [19]

Deuring

[11] 4,199,886

[45] Apr. 29, 1980

[54] GUNS

[76] Inventor: Albert Deuring, Maurachgasse 14, A-6900 Bregenz, Austria

[21] Appl. No.: 898,562

[22] Filed: Apr. 21, 1978

[30] Foreign Application Priority Data

Apr. 26, 1977 [CH] Switzerland ..... 5184/77

[51] Int. Cl.[2] ..... F41C 11/08

[52] U.S. Cl. ..... 42/44; 42/40; 42/45

[58] Field of Search ..... 42/44, 45, 40, 41

[56] References Cited

U.S. PATENT DOCUMENTS

| | | | |
|---|---|---|---|
| 254,728 | 3/1882 | Tonks | 42/45 |
| 804,349 | 11/1905 | Stendebach | 42/40 |
| 926,456 | 6/1909 | Behr | 42/40 |
| 928,608 | 7/1909 | Jaeger | 42/44 |

FOREIGN PATENT DOCUMENTS

| | | | |
|---|---|---|---|
| 198200 | 5/1908 | Fed. Rep. of Germany | 42/44 |

*Primary Examiner*—Charles T. Jordan

*Attorney, Agent, or Firm*—Pollock, Vande Sande and Priddy

[57] ABSTRACT

A gun comprising a stock having a lock housing and a barrel pivotable relative to the lock housing and having a forked member provided with guide grooves engaged by guide ribs on a locking block so that as the gun is opened the grooves slide up the ribs and the block pivots on the lock housing.

7 Claims, 6 Drawing Figures

GUNS

BACKGROUND OF THE INVENTION

1. Field of the Invention

The present invention relates to a sporting weapon, especially a hunting gun.

2. Description of the Prior Art

In conventional hunting guns with tiltable barrels the locking of the utilized block with the barrels takes place indirectly, which is not completely satisfactory. The block in this case closes and opens the barrels in relation to a fixed housing.

SUMMARY OF THE INVENTION

Now the present invention is concerned with a sporting weapon, especially a hunting gun, which is distinguished in that, facing the bore of the tiltable barrel, a locking block is provided in a barrel fork piece and comprises mutually engaging and mutually adapted locking means which are in sliding engagement with one another and effect a direct locking when the gun is opened and closed.

Figure 1:
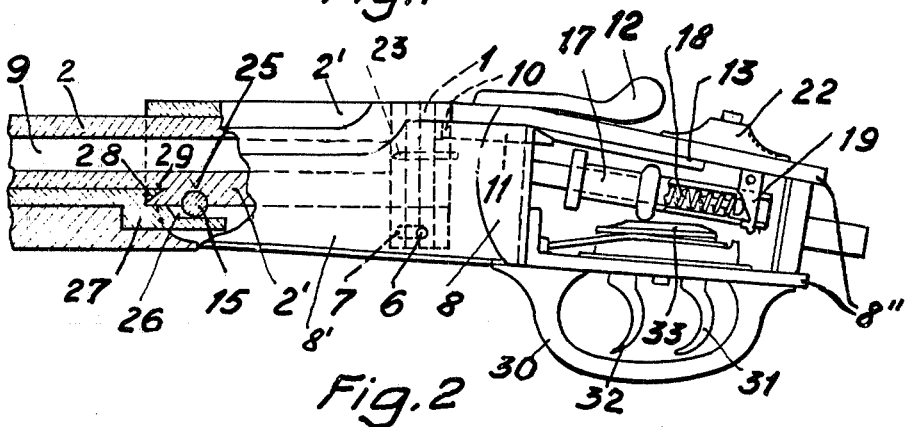
FIG. 1 shows a view of the gun lock with partial longitudinal sections, with the striker uncocked.
Figure 2:
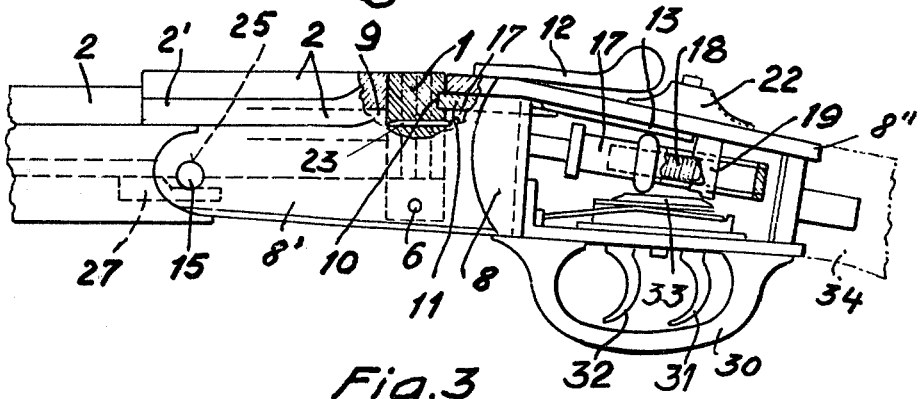
FIG. 2 shows a view of the gun lock with the striker cocked.
Figure 3:
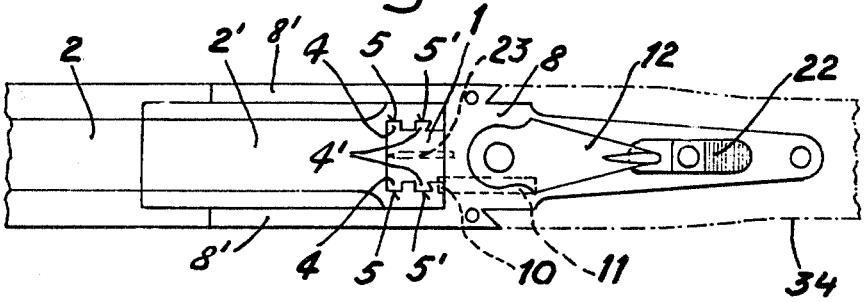
FIG. 3 shows a plan view of FIG. 2.

DESCRIPTION OF THE PREFERRED EMBODIMENT 1 designates a locking block of parallelepipedal type which is arranged in the lock housing 8 for limited pivoting in the vertical plane between the fork arms 2″ of the barrel fork piece 2′ of the gun barrel 2. On its two longitudinal flanks the locking block 1 possesses guide ribs 4, 4′ which engage in correspondingly profiled guide grooves 5, 5′ on the inner sides of the fork arms 2″ of the barrel fork piece 2′, as shown by FIGS. 3 and 6. The forward guide ribs 4 towards the gun barrel 2 are prismatic, seen from above, while the rear guide ribs 4′ are of dovetail form. The interengaging guide ribs 4, 4′ and the guide grooves 5, 5′ represent a direct locking of the block 1 with the barrel fork piece 2′. The locking block 1 thus possesses a secure lateral guidance and retention which withstand the maximum gas pressure occurring on the delivery of a shot. The locking block 1 is mounted for a certain pivoting in the vertical plane on the bearing bolt 6 which in turn is somewhat displaceable in the longitudinal direction in slots 7 in the side walls 8′ of the lock housing 8. When the gun is opened, i.e., the gun barrel 2 with the barrel fork piece 2′ is tilted in relation to the lock housing 8 into the position shown in FIGS. 5 and 6, the barrel fork piece 2′ moves upwards in relation to the locking block 1, which in this action remains in engagement with the fork piece. The interengaging ribs 4, 4′ and grooves 5, 5′ here guarantee the secure displaceable guidance and retention of the locking block 1 in the barrel fork piece 2′. The locking block 1 here pivots at its top about the bearing bolt 6 in the vertical plane through about 4–5 mm. After shot firing and for reloading the gun barrel is tilted back into the position according to FIGS. 5 and 6. The side of the barrel bore 9 facing the locking block 1 (FIGS. 5, 6) is then clear to the rear so that the ejection of the cartridge can proceed and a new cartridge can be inserted. On its rear side facing the lock housing 8 the locking block 1 has a detent 10 in which the bolt 11 partially engages when the gun is closed (FIGS. 1 to 3) and effects a locking. At the same time the barrel fork piece 2′ with the gun barrel 2 is arrested with the locking block 1. The bolt 11 is in movement connection with the locking lever 12 and the latter is displaceable in the transverse direction on the lock housing 8. The locking lever 12 is subject to the action of the usual springs 13, partially resting one upon the other, so that after displacement it always travels back automatically into the initial position shown in FIGS. 3 and 6, in which the bolt 11 lies in the detent 10 of the locking block 1 and arrests the latter. In the side walls 8′ at the front side of the lock housing 8 there lies the joint bolt 15 which penetrates the locking block 1. The barrel fork piece 2′ with the barrel 2 and the stock can be pivoted in known manner about the joint bolt 15 and especially tilted forwards in relation to the lock housing 8, as shown by FIGS. 5 and 6.

Figure 4:
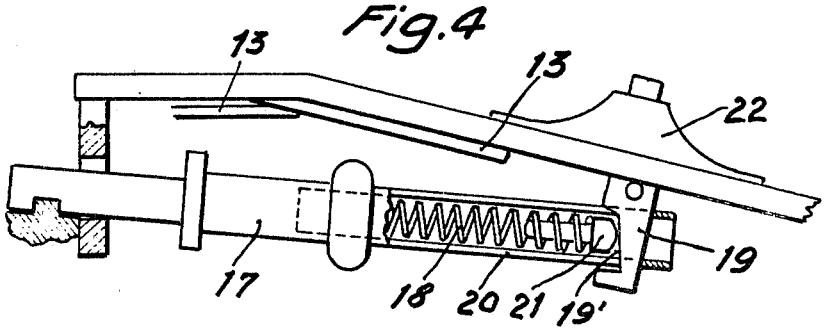
FIG. 4 shows a detail of FIG. 1 on a larger scale.

Within the lock housing 8 there is situated the lever mechanism, comprising a well-known self-cocking and ejection mechanism. For the pivotable locking of block 1 a special striker mechanism explained below is expedient. 17 designates the striker which bears by means of the striker spring 18 against an angle piece 19, which as is the case in hunting guns bears against the cocking slider 22. The forward part of the striker 17 can be moved up and down somewhat and the angle piece 19 extends through a slot 20 in the striker. The striker 17 has on its hollow-cylindrical rear part, which accommodates the striker spring 18, the longitudinal slot 20 (FIG. 4) which serves for the sliding guidance of the angle piece 19. The striker spring 18 bears with a headed bolt 21 against the oblique face 19′ of the angle piece 19. The oblique face 19′ which takes up the pressure of the striker spring 18 effects the pressing away of the striker 17. The latter in known manner acts upon the striker pin 23 which lies in the solid transverse part of the lock housing 8. When the gun is closed the striker pin 23 stands in the readiness position facing the barrel bore 9.

Figure 5:
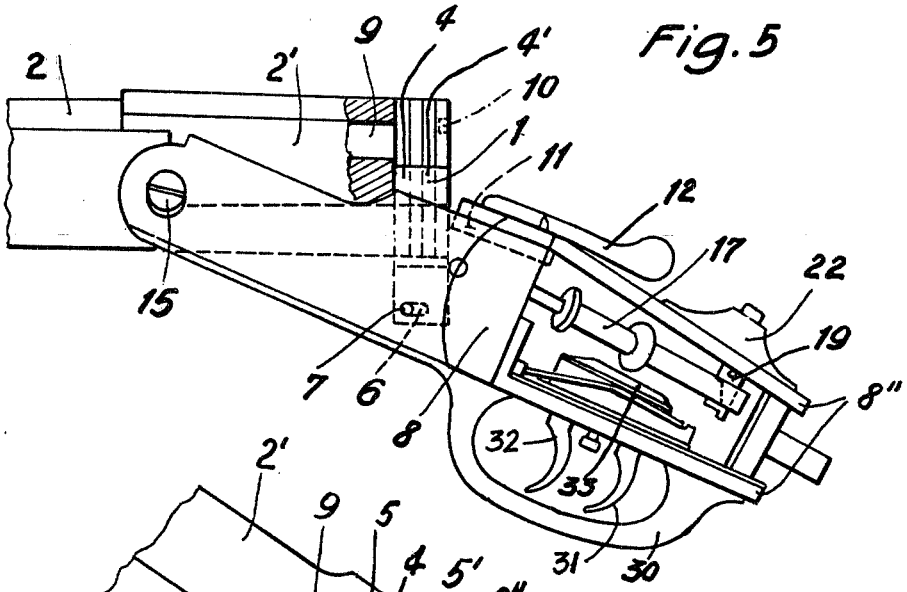
FIG. 5 shows the gun lock in the open position with a partial section through the barrel fork piece.
Figure 6:
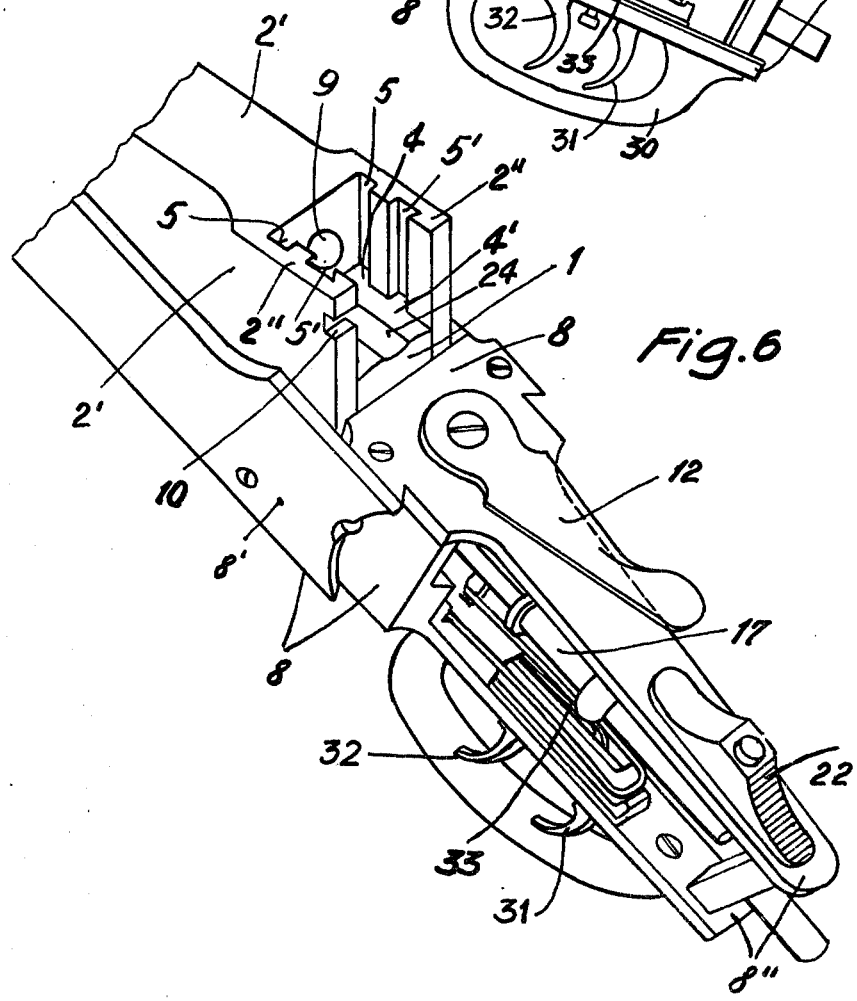
FIG. 6 shows a perspective representation of FIG. 5.

The upper side of the locking block 1 possesses a concave surface 24 (FIG. 6) which lies flush with the lower curve part of the barrel bore 9 when the barrel with the fork piece and the stock is tilted into the position according to FIGS. 5 and 6.

The joint bolt 15 engages in its upper half in the channel 25, adapted thereto, in the barrel fork piece 2′ and rests on the step 26 of the retaining piece 27, which latter is firmly seated on the gun barrel 2. A tooth 28 on the retaining piece 27 here engages in a recess 29, which is acute-angled seen in longitudinal section, in the barrel fork piece 2′. Into the frame 8″ of the lock housing 8 there are also installed the trigger guard 30, the hair trigger 31, the first-pressure trigger 32 and the trigger mechanism 33.

The lock housing 8 with the frame 8″, as is generally the case in guns, is detachably made fast by securing members such as a threaded bolt in the gun butt 34, indicated in dot-and-dash lines.

In the gun as described the locking block 1, both in the opened condition with barrel 2 tilted forward and downward and in the closed condition, always remains in direct connection with the barrel fork piece 2', which guarantees mutually good guidance and retention, which is not impaired by the maximum gas pressure in shot firing or the firing of ball or shot cartridges. The danger of wear is thus substantially reduced; moreover incorrect, dangerous or harmful manipulations in the opening and closing of the gun are normally impossible.

I claim:

1. A gun having a lock housing and a barrel pivotable relative to the lock housing, a fork piece on the barrel, and a locking block adjacent the end of the bore of the barrel, the fork piece and locking block being provided with interengaging and mutually adapted locking means which are in sliding engagement with one another and which comprise forward ribs and matching grooves of prismatic form and rear ribs and matching grooves of dovetail form.

2. A gun having a lock housing and a barrel pivotable relative to the lock housing, a fork piece on the barrel, and a locking block adjacent the end of the bore of the barrel, the fork piece and locking block being provided with interengaging and mutually adapted locking means which are in sliding engagement with one another, the lock housing containing a trigger mechanism and a longitudinally displaceable cocking slider which is connected with an angle stop which possesses an oblique face against which there bears a spring-loaded bolt in a striker mechanism.

3. A gun having a stock, a lock housing and a barrel which is tiltable relative to the lock housing, a fork piece on the barrel, and a locking block adjacent the end of the bore of the barrel between said barrel and the stock of said gun, said locking block being mounted for continual connection to the said barrel, said locking block being movable upwardly and downwardly in said forkpiece while being simultaneously pivotable through a limited distance in a vertical plane about a bearing bolt, said bearing bolt being guided for slidable movement in slots located in the sidewalls of the lock housing.

4. The gun of claim 3 wherein said locking block is provided with a detent, and a bolt positioned to engage said detent to provide additional locking.

5. The gun of claim 3 wherein said locking block includes a plurality of elongated ribs which are adapted to slide in complementarily shaped grooves provided in said fork piece.

6. The gun of claim 5 wherein at least some of said ribs and the grooves associated therewith have a prismatic configuration.

7. The gun of claim 5 wherein at least some of said ribs and the grooves associated therewith have a dovetail configuration.

* * * * *